US011326760B2

(12) United States Patent
Cubon et al.

(10) Patent No.: US 11,326,760 B2
(45) Date of Patent: May 10, 2022

(54) LIGHT ASSEMBLY HEATER SYSTEMS, APPARATUS, AND METHODS

(71) Applicant: TRAMEC TERMICO TECHNOLOGIES LLC, Elk Grove Village, IL (US)

(72) Inventors: Michael M. Cubon, Park Ridge, IL (US); Alec Michael Holm, Bloomingdale, IL (US)

(73) Assignee: TRAMEC TERMICO TECH, L.L.C., Elk Grove Village, IL (US)

( * ) Notice: Subject to any disclaimer, the term of this patent is extended or adjusted under 35 U.S.C. 154(b) by 0 days.

(21) Appl. No.: 17/106,448

(22) Filed: Nov. 30, 2020

(65) Prior Publication Data

US 2021/0285616 A1 Sep. 16, 2021

Related U.S. Application Data

(60) Provisional application No. 62/988,784, filed on Mar. 12, 2020.

(51) Int. Cl.
*F21S 45/60* (2018.01)
*F21Y 115/10* (2016.01)

(52) U.S. Cl.
CPC ..... *F21S 45/60* (2018.01); *F21Y 2115/10* (2016.08)

(58) Field of Classification Search
CPC . F21S 45/60; F21S 45/33; F21S 45/37; F21Y 2115/10; B60Q 1/0005; H05B 3/84
See application file for complete search history.

(56) References Cited

U.S. PATENT DOCUMENTS

| | | | | |
|---|---|---|---|---|
| 7,262,388 | B2 | 8/2007 | Moreth et al. | |
| 7,300,191 | B2 * | 11/2007 | Oshio | F21S 45/33 362/545 |
| 7,914,162 | B1 * | 3/2011 | Huang | F21V 3/04 362/92 |
| 2012/0281424 | A1 * | 11/2012 | Hansen | F21S 41/192 362/517 |
| 2013/0249375 | A1 * | 9/2013 | Panagotacos | B64D 47/04 313/13 |
| 2019/0017676 | A1 * | 1/2019 | Van Straten | F21S 45/60 |
| 2019/0184940 | A1 * | 6/2019 | Moon | H05B 1/0236 |
| 2019/0306926 | A1 * | 10/2019 | Deering | F21V 29/90 |

* cited by examiner

*Primary Examiner* — Peggy A Neils
(74) *Attorney, Agent, or Firm* — Tarolli, Sundheim, Covell & Tummno LLP

(57) ABSTRACT

A heater system for an LED light assembly having a lens and a plurality of LED lights includes a heating element positioned behind and spaced from the lens and having openings aligned with the LED lights for allowing light from the LED lights to pass therethrough.

19 Claims, 10 Drawing Sheets

LIGHT ASSEMBLY HEATER SYSTEMS, APPARATUS, AND METHODS

RELATED APPLICATIONS

This application claims priority from U.S. Provisional Application Ser. No. 62/988,784, filed Mar. 12, 2020, the entirety of which is incorporated by reference herein.

TECHNICAL FIELD

The present invention relates generally to heater systems, and specifically to heater systems for light assemblies.

BACKGROUND

Light Emitting Diodes (LED) are becoming the primary lighting source for headlights and taillights in automotive, commercial trucking, construction, and aerospace vehicles. The replacement cost of incandescent bulbs alone is as high as 90%, which would be enough reason to use LED lights. Additionally, traditional incandescent bulbs, that were widely used prior to the introduction of LEDs, are rated for two years of vehicle use. Changing the bulbs is challenging and costly. Lastly, LEDs are becoming brighter and more energy efficient, resulting in power savings and ultimately fuel savings.

SUMMARY

In one example, a heater system is provided for an LED light assembly having a lens and a plurality of LED lights. The heater system includes a heating element positioned behind and spaced from the lens and having openings aligned with the LED lights for allowing light from the LED lights to pass therethrough.

In another example, a heater system for an LED light assembly having a lens includes a board assembly having LED lights connected thereto. A heating element is positioned behind and spaced from the lens and has openings aligned with the LED lights for allowing light from the LED lights to pass therethrough. A spacer is secured to the heating element for positioning the heating element a predetermined distance from the lens. The spacer includes openings aligned with the openings in the heating element.

Other objects and advantages and a fuller understanding of the invention will be had from the following detailed description and the accompanying drawings.

DETAILED DESCRIPTION

Figure 1:
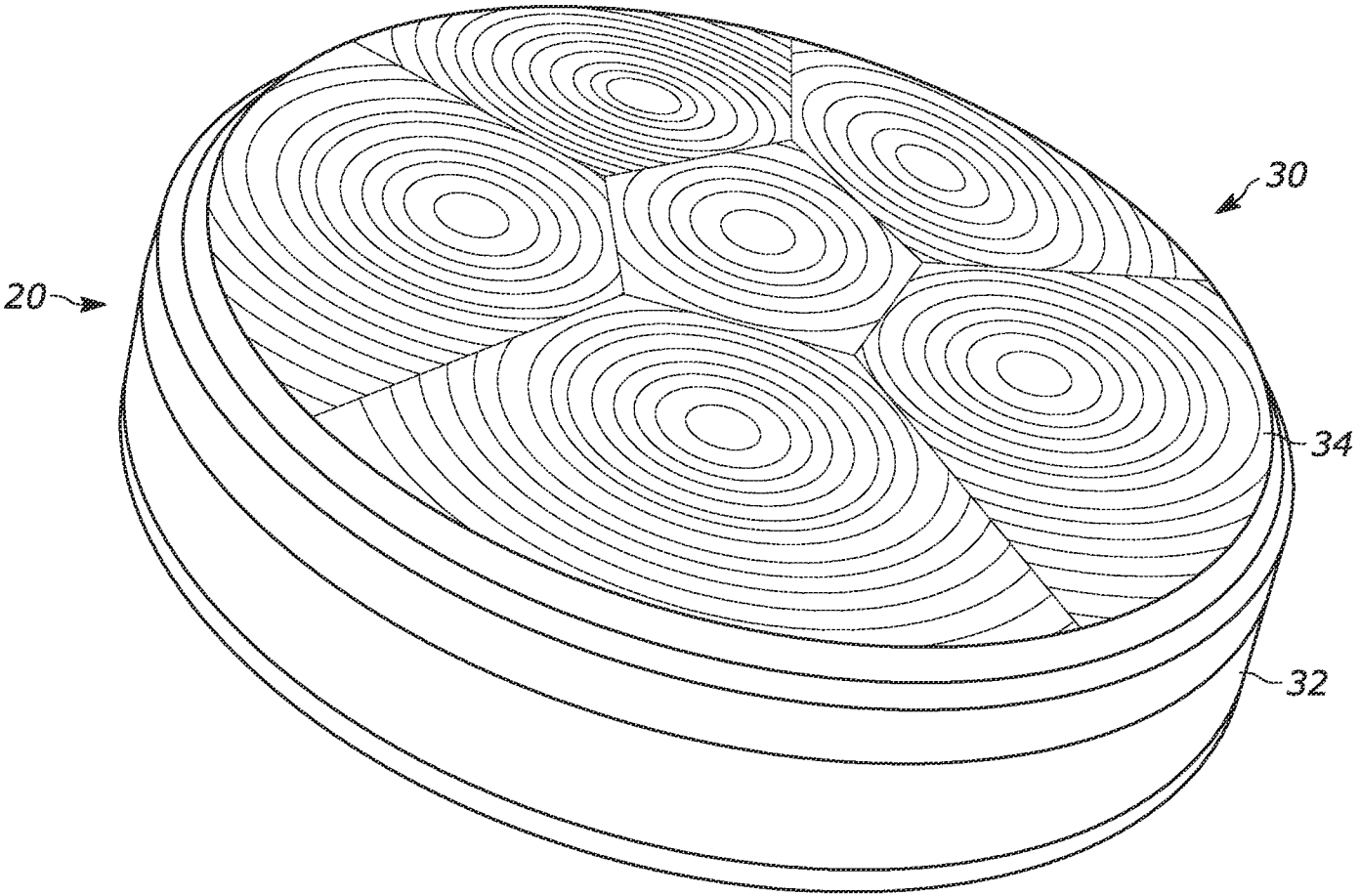
FIG. 1 is a schematic illustration of a light assembly including an example heater system.

The present invention is directed to an LED light that utilizes heat to keep snow, ice or fog from forming on the lens. The LED light may be a LED headlight or taillight assembly that may be exposed to weather, and more specifically, to an LED vehicle head light or tail light that is responsible for line of site illuminating or signaling stop/turn/breaking of a vehicle.

In the field of vehicle LED lighting assemblies, some embodiments of the invention are directed to providing an aftermarket product that is added to the LED light assembly after the production of the vehicle or light assembly. Some embodiments of the invention are directed to providing an integrated OEM product that is positioned within the LED light assembly, e.g., inside the housing that includes a lens and back cover.

In such cases, the LED light assembly can be ultrasonically welded shut to enclose the LED(s) and other internal components. The heater system can be carried by the LED light assembly or connected to an internal item within the enclosure of the LED assembly.

The heater system shown and described herein is in a heating relationship with a lens of an LED light assembly. The heater system includes a heating element formed as a fixed wattage heater or a phase-changing, resistive polymer composite. In the latter configuration, a resistive layer of the composite is in a heating relationship with the lens of the LED light assembly by being positioned a distance to the lens sufficient to apply heat thereto, e.g., sufficient to thaw the lens or buildup of ice or snow on the lens comparable to an incandescent light.

To this end, the resistive polymer layer can constitute a positive temperature coefficient (PTC) element containing conductor particles, e.g., a conductive carbon black filler material, dispersed in a polymer base or matrix having a crystalline structure. The crystalline structure of the matrix densely packs the conductor particles into its boundary so they are close enough together at room temperature to form chains and allow conductive paths of current to flow through the polymer insulator via these carbon chains.

When the resistive layer is at room temperature, there are numerous carbon chains forming conductive paths through the matrix. In some embodiments, there are two conductive buses with each having a corresponding terminal connected to the resistive layer. When a voltage is applied across the resistive layer from the conductive buses, the layer carries a current via the conductor particles. As a result, the temperature of the resistive polymer layer rises until it exceeds the polymer's transition temperature, causing the polymer to change from its initial crystalline phase to an amorphous phase. In the amorphous phase, the conductor particles are spaced further apart from one another [relative to the crystalline phase] and, thus, the electrical resistance of the resistive polymer layer increases until current is prevented from passing through the resistive layer. This, in turn, prevents current from passing through the conductive buses to prevent further heating thereof.

An insulating layer can be configured to work in relation to the heat generated by the resistive layer to direct heat in a direction or to block heat flow emanating towards a region. The insulating layer can be positioned as a layer over or under the resistive layer.

The present technology provides a low profile, e.g., flat, and highly adaptable, e.g., flexible, device that can be integrated into LED light assemblies while providing heating at the same or similar level to an incandescent bulb for a similar application. The heater system can be adapted to fit the LED light assembly. This allows end users to conveniently retrofit the composite to existing light assemblies and eliminate the cost of purchasing and replacing an entire lighting assembly.

To this end, the composite can be located on a surface of an LED board opposite to a lens or an internal surface of a light enclosure opposite to a lens. Advantageously, the composite self-regulates its temperature and prevents overheating, thereby providing a sufficient and stable heat source to not only de-fog/de-ice lighting systems used in a variety of safety applications but also sustain the performance of ancillary electronic components over time.

It should be understood that embodiments of the present invention are particularly suited for outdoor LED light assemblies but one skilled in the art would understand the present invention may not be limited only to outdoor LED light assemblies.

It should be also contemplated that one or more than one intermediate layers may be present among the layers of the polymeric PTC composite. Alternatively, without one or more than one intermediate layers, each layer of the polymer directly touches adjacent layers. Each layer of the composite may be present with a single layer or multiple layers.

A mention of a layer should not be interpreted to mean that it only means a single layer. Also the physical arrangement illustratively shown herein may show or describe direct contact or overlying relationship between physical elements. This can indicate direct physical contact but it should not be understood to be necessarily limited to it.

Some known heater systems or techniques have used etching to make fixed resistance heaters, which involve creating conductive pathways using an etching process. The illustrative embodiments described herein to implement polymeric, PTC, resistive-based heating can avoid the need to use an etching process which can have advantages.

Unless defined otherwise, all technical and scientific terms used herein have same meaning as commonly understood by one of ordinary skill in the art to which this invention belongs. Also, as used herein and in the appended claims, the singular form "a", "and", and "the" include plural referents unless the context clearly dictates otherwise.

The term "composite" herein specifically means a composite structure that includes a conductive layer and a resistive layer experiencing a PTC effect, both of which can include a polymer.

The term "about" herein specifically includes ±10% from the indicated values in the range.

Other terms or words that are used herein are directed to those of ordinary skill in the art in this field of technology and the meaning of those terms or words will be understood from terminology used in that field or can be reasonably interpreted based on the plain English meaning of the words in conjunction with knowledge in this field of technology. This includes an understanding of implicit features that for example may involve multiple possibilities, but to a person of ordinary skill in the art a reasonable or primary understanding or meaning is understood.

Figure 2:
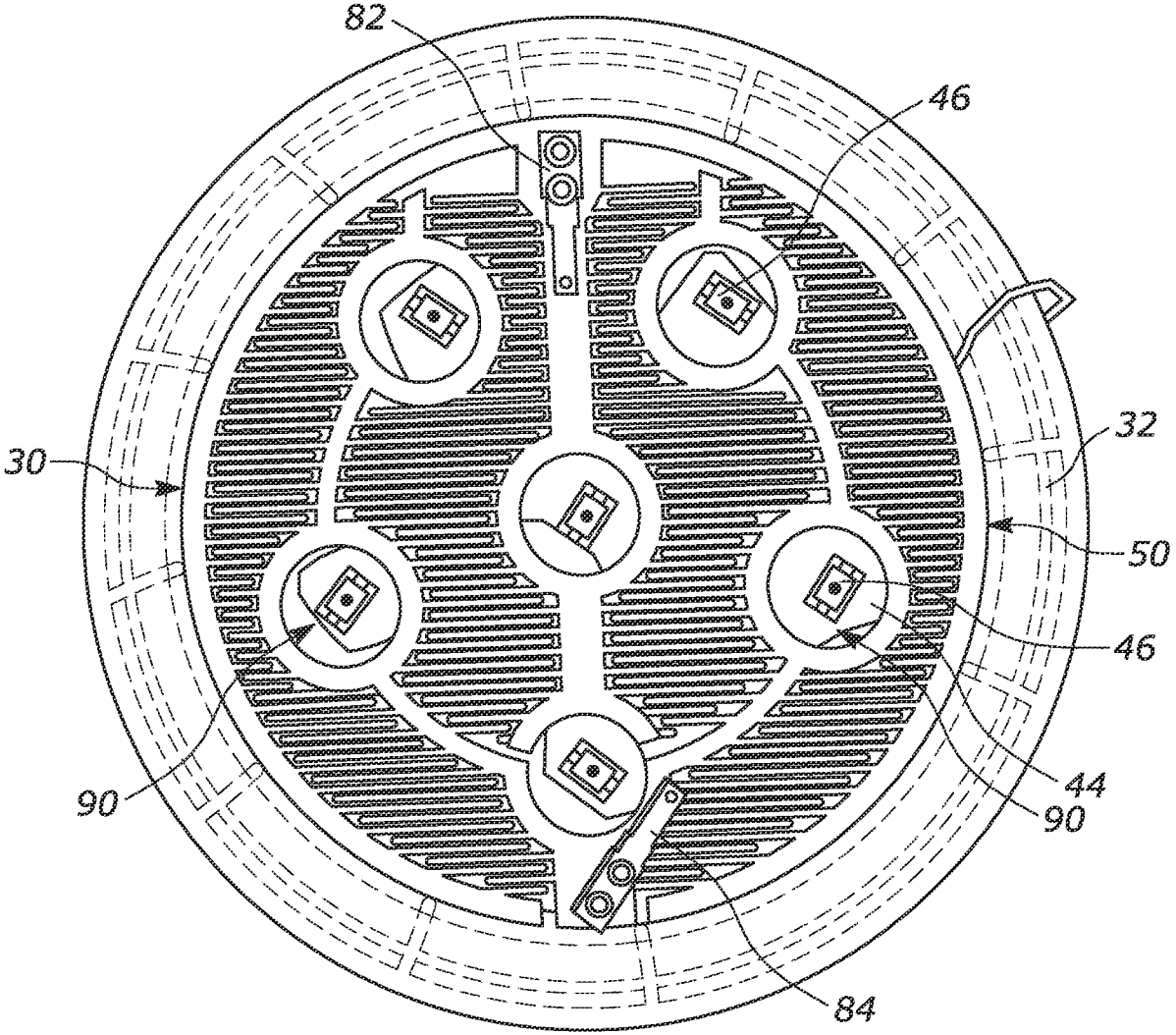
FIG. 2 is a top view of the light assembly of FIG. 1 with the lens removed.

With this in mind, FIGS. 1-2 illustrate an example heater device or system 20 for an LED light assembly 30. The LED light assembly 30 shown in FIG. 1 is round/circular and configured for use on, for example, a trailer, truck, municipal vehicle or snow plow as a stop-turn-tail light. The light assembly 30 includes an enclosure 32 having a lens 34 connected thereto. The lens 34 can be round, square, etc. An LED circuit board assembly 44 (see FIG. 2) is provided within the enclosure 32 behind the lens 34. A series of LEDs 46 is mounted to the LED board assembly 44 so as to emit light through the lens 34.

Figure 3A:
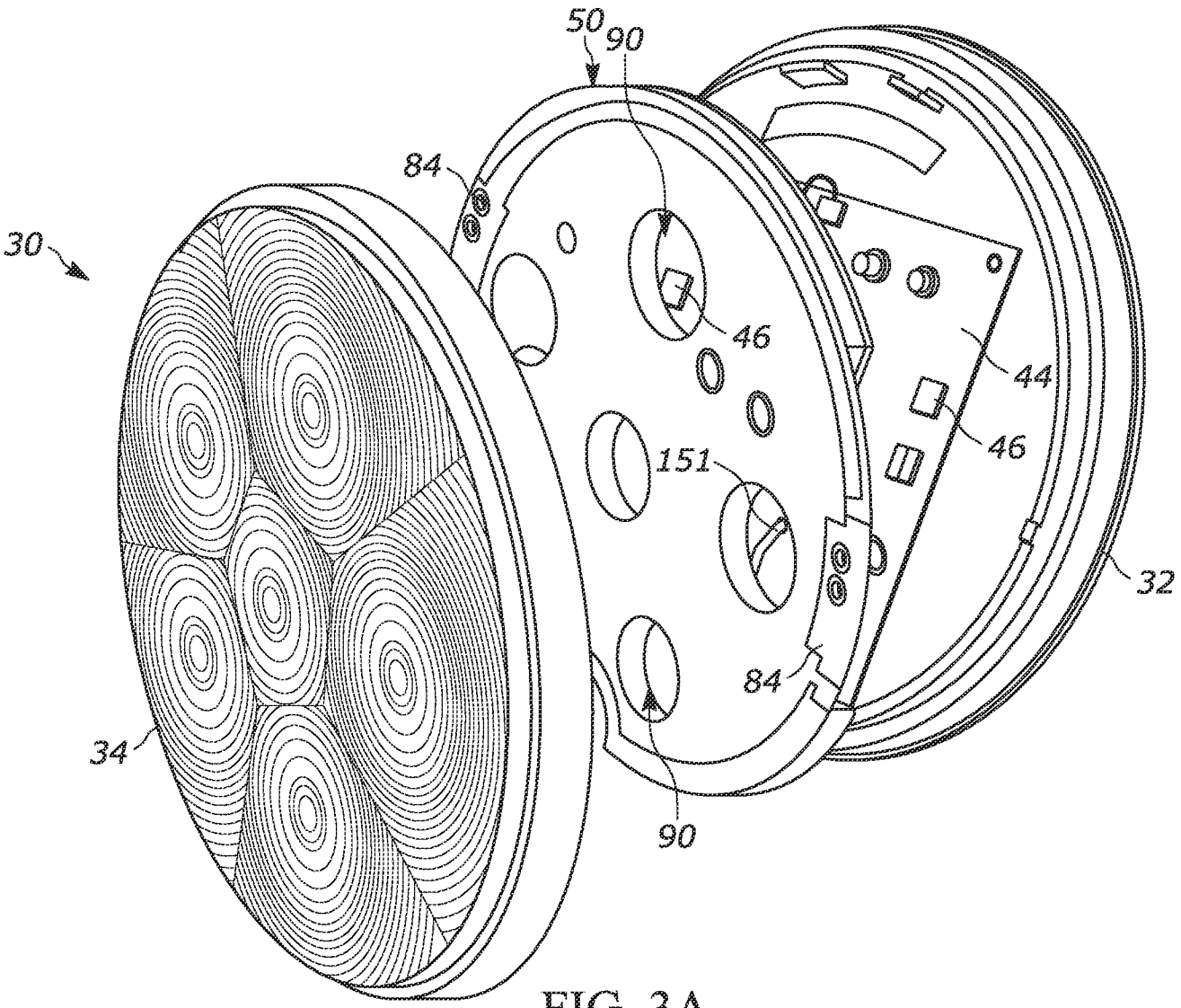
FIG. 3A is an exploded view of the light assembly of FIG. 1.

The heater system 20 includes a heating element formed as a composite 50 connected to the board assembly 44. The composite 50 can be flexible or rigid. The composite 50 is positioned between the lens 34 and the board assembly 44 and can be electrically connected thereto by wires 151 (see FIGS. 3A-3B). Alternatively, as noted, the heating element can be formed as a fixed wattage heater (not shown).

Figure 4:
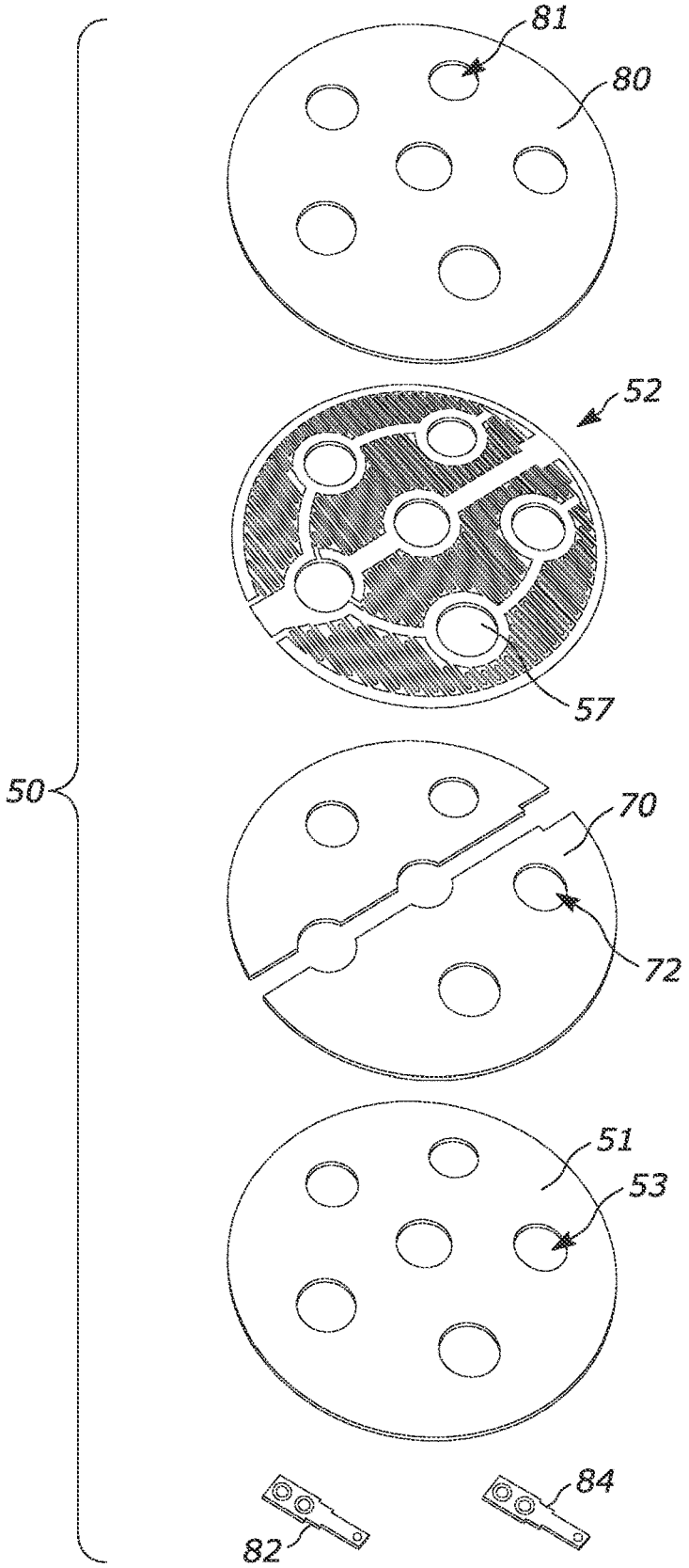
FIG. 4 is an exploded view of the heater system for the light assembly of FIG. 1.
Figure 5:
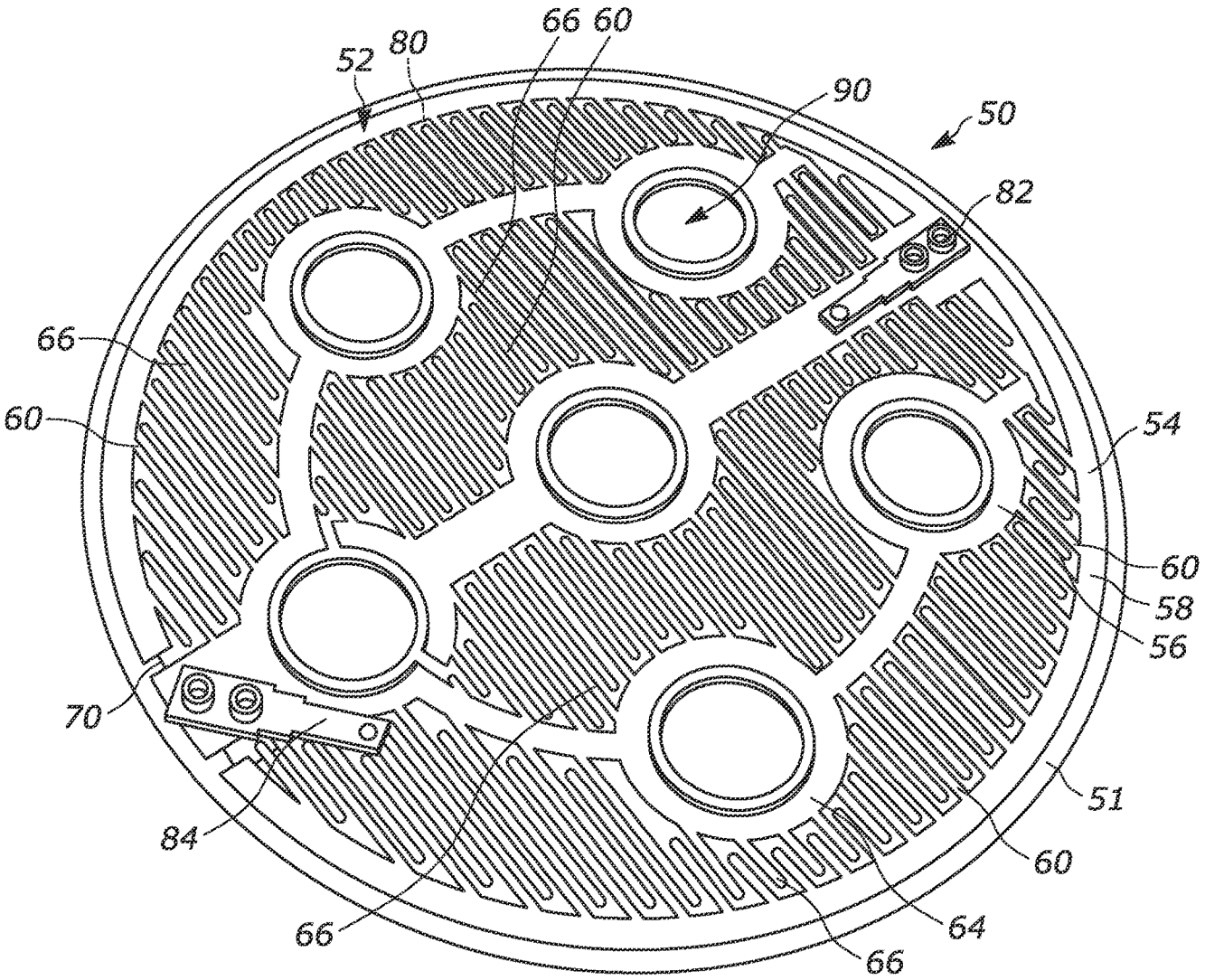
FIG. 5 is a top view of a composite of the heater system.

Referring to FIGS. 4-5, the composite 50 includes a first or carrier layer 51 made of an electrically insulating material that can be impervious to water and other debris to extend the service life of the products. Openings 53 extend through the carrier layer 51 and are arranged in a pattern that mirrors the location of the LEDs 46 on the board assembly 44.

The composite 50 further includes a polymer base layer 52 formed from a conductive material. The polymer base layer 52 can be, for example, a screen printed, flexible polymeric ink. The polymer base layer 52 includes a first bus 54 and second bus 56 spaced from each other. The first bus 54 includes a base 58 and finger portions 60 extending away from the base. The second bus 56 includes a base 64 and finger portions 66 extending away from the base. The finger portions 60, 66 extend towards one another and can be interdigitated. That said, the finger portions 60, 66 are spaced from one another. The polymer base layer 52 includes openings 57 arranged in the same pattern as the openings 53 in the carrier layer 51.

A resistive layer 70 is connected to, e.g., screen printed on, the polymer base layer 52 and can be modified or formed in desired shapes to electrically connect the first bus 54 to the second bus 56. The resistive layer 70 can be formed in one or more pieces. The resistive layer 70 includes openings 72 arrange in the same pattern as the openings 53, 57 in the carrier and polymer base layers 51, 52.

The resistive layer 70 can be positioned between the polymer base layer 52 and the carrier layer 51 (as shown) or on top of the polymer base layer to sandwich the same between the layers 51, 70 (not shown). In any case, the resistive layer 70 can have a higher electrical resistance than the polymer base layer 52 and experience a PTC effect when heated by current.

That said, the resistive layer 70 will ultimately reach a designed steady-state temperature in which current is restricted/slowed from passing through the resistive layer and, thus, restricted/slowed from passing through the buses 54, 56. The resistive layer 70 will thereafter draw a reduced amperage required to maintain the steady state temperature, thereby self-regulating its temperature and helping to prevent overheating. The resistive layer 70 will stay "warm"—remaining in the high electrical resistance state as long as power is applied.

On the other hand, removing power will reverse the phase transformation—causing contraction of the matrix—and allow the carbon chains to re-form as the polymer matrix re-crystallizes. The electrical resistance of the resistive layer 70 (and therefore of the composite 50) thereby returns to its original value. In other words, the resistive layer 70 is electrically conductive at room temperature but heating the resistive layer reduces its electrical conductivity until current is restricted/slowed from passing therethrough.

An interface layer 80 helps to connect the composite 50 to the board assembly 44 and completely seals the composite. In one example, the interface layer 80 directly engages the board assembly 44. The interface layer 80 can be directly connected to at least one of the polymer base layer 52 and the resistive layer 70. The interface layer 80 can be, for example, a double-sided adhesive. The interface layer 80 can include a peelable adhesive liner or backing including, for example, paper, vinyl or mixtures thereof (not shown). Alternatively or additionally, mechanical fasteners (not shown) can connect the composite 50 to the board assembly 44. Still alternatively, the composite 50 can be directly attached to the inside of the enclosure 32 and/or suspended within the enclosure spaced from the board assembly 44.

Regardless, when the composite 50 is assembled (FIG. 5), the components 51, 52, 70, 80 are oriented such that the respective openings 53, 57, 72, 81 are aligned with one another, thereby collectively forming openings or passages 90 extending entirely through the composite. The LEDs 46 are aligned with the openings 90 such that light emitted by the LEDs passes through the openings to the lens 34. That said, the number of openings 90 is variable based on the designed light output and number of LEDs 46. The openings 90 can be round/circular (as shown), polygonal or have any open or closed perimeter.

The heater system 20 further includes a rivet or crimped first terminal 82 connected to the first bus 54. A rivet or crimped second terminal 84 is connected to the second bus 56. The terminals 82, 84 can be generally planar (as shown) or angled, e.g., 90° terminals (not shown). The terminals 82, 84 can be electrically connected with riveted or crimped terminations to the LED board assembly 44 via the wires 151. The wires 151 can connect to the terminals 82, 84 and board assembly 44 via wire harness, spade connections, etc.

In instances where one or more of the components of the composite 50 are screen printed directly onto the surface of the LED board assembly 44, the electrical connections can be made directly to copper pads thereon (not shown). Silver through-hole printing/vias can also be utilized to make connections between the composite 50 and the board assembly 44. The connections are then sealed with a UV encapsulating material.

Figure 3B:
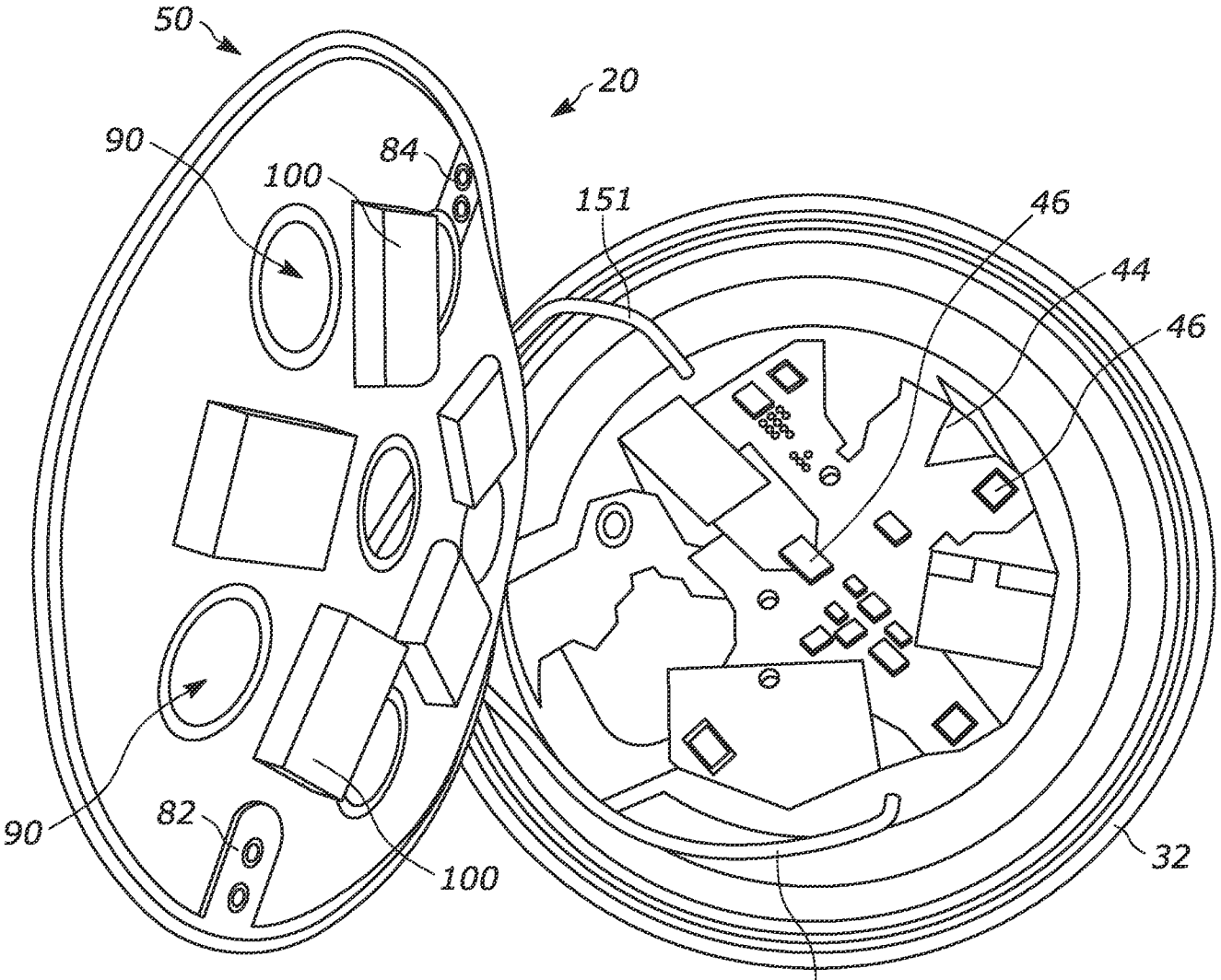
FIG. 3B is a top view of a portion of FIG. 3A.

It will be appreciated that the composite 50 can optionally be secured to the board assembly 44 with a spacer constituting a foam adhesive 100 (see FIG. 3B). The foam 100 can be formed as one or more pieces secured to the interface layer 80 and spaced from the openings 90. The foam 100 has a thickness configured to position the composite 50 a desired distance from the deicing surface of the lens 34. The composite 50 is not directly secured to the lens 34 or contact the lens regardless of whether the foam 100 is present or not. In other words, the lens 34 and composite 50 are spaced from one another.

The foam 100 can have a variety of sizes, shapes, and thicknesses (including variable) depending on the geometry of the lens 34 and/or the particular application or environment. To this end, the thickness of the foam 100 can be tailored to meet a desired light output for the light assembly 20. The foam 100 can also provide thermal insulation to the surrounding components and/or contain locating features (not shown) to facilitate assembly.

Figure 6:
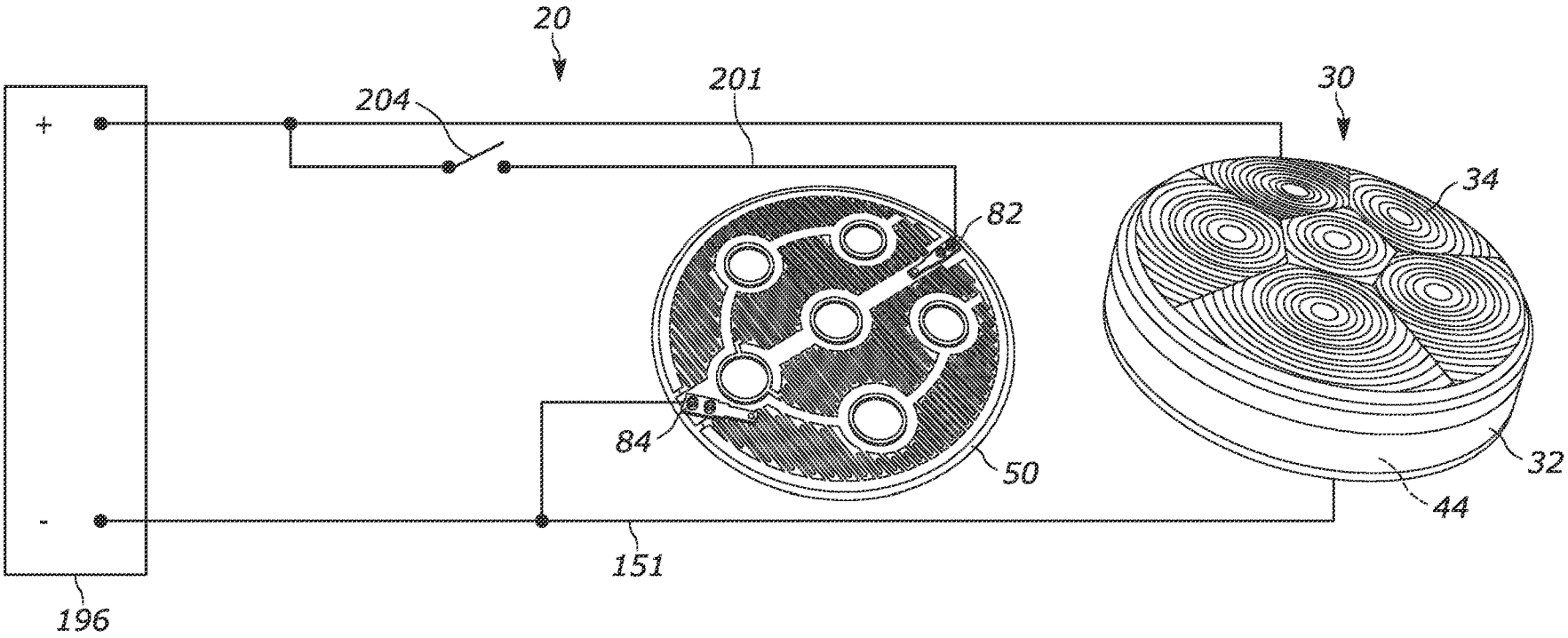
FIG. 6 is a wiring schematic for the light assembly.

FIG. 6 illustrates a schematic diagram of a circuit for the heater system 20. As noted, wires 151 connect the terminals 82, 84 to the board assembly 44. Wiring 201 connects the LED light assembly 30 and composite 50 to a common voltage supply device or power supply 196. Alternatively, an independent wire harness (not shown) can be secured to the composite 50 for connecting the same to an independent power supply (not shown). In any case, the composite 50 can operate with about 12V of voltage and about 15 W of power.

A thermostat 204 is connected to the wiring 201 or wire harness to enable control and/or programming of power flow between the power supply 196 and the composite 50. The thermostat 204 can be programmed to initiate current flow from the power supply 196 to the composite 50 when the temperature around the LED light assembly 30 falls below a predetermined value, e.g., about 0° C.

That said, upon vehicle startup or during vehicle operation, the thermostat 204 monitors the temperature around the LED light assembly 30. When the temperature falls below the predetermined value, the thermostat 204 initiates current flow to the composite 50. As the temperature of the composite 50 rises and causes the PTC effect, the heat is transferred to the lens 34, which thereby helps to prevent, reduce or remove snow and ice accumulation thereon. The thermostat 204 can continue supplying current to the composite 50 so long as the temperature is below the predetermined value, thereby helping to ensure light from the LEDs 46 is visible through the lens 34 despite inclement weather. The thermostat 204 can cease current supply to the composite 50 when the temperature reaches the predetermined value or the vehicle is shut off.

Figure 7:
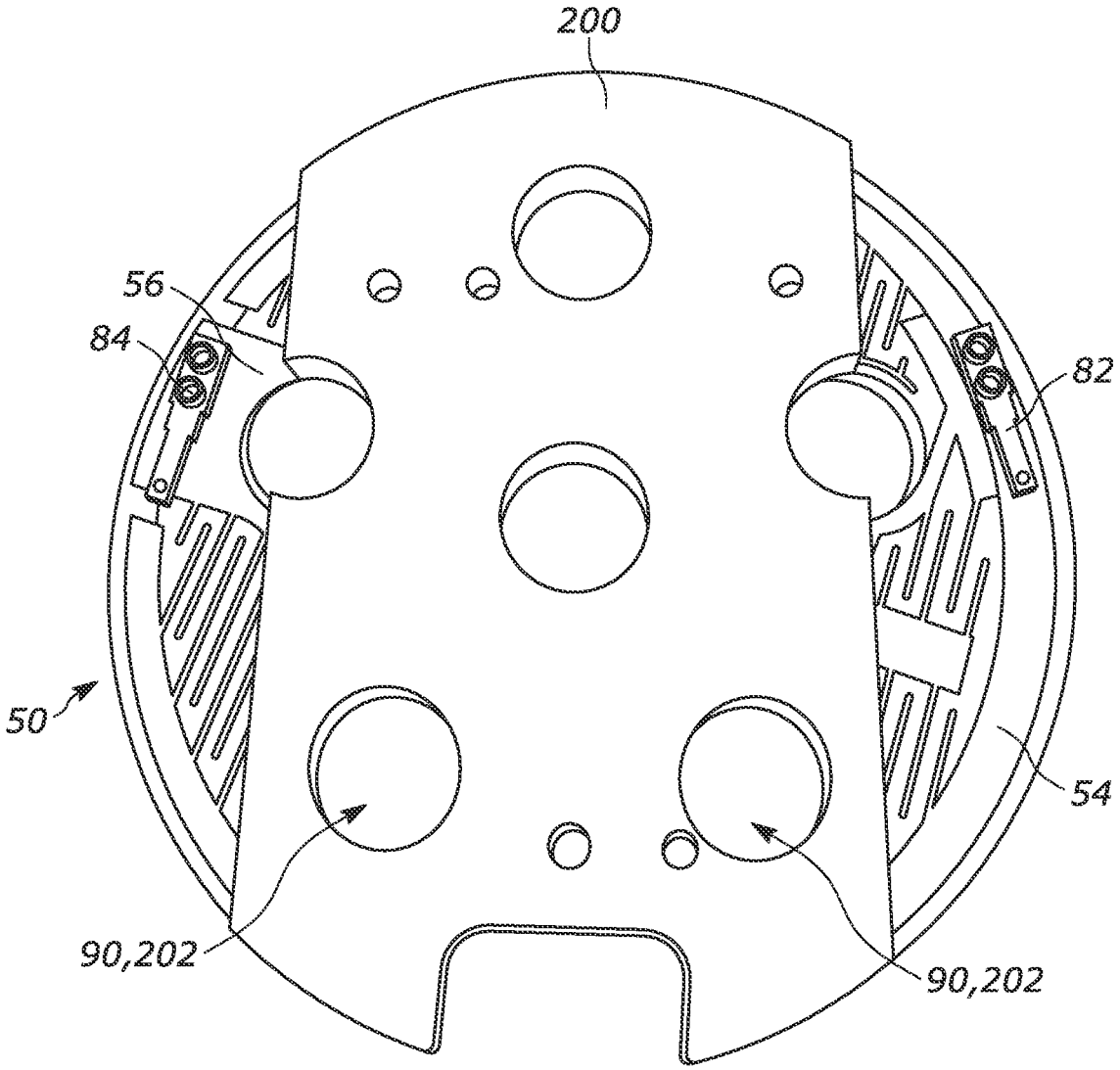
FIG. 7 is a schematic illustration of another example spacer for the heater system.

Another example spacer 200 for connecting the composite 50 to the board assembly 44 is shown in FIG. 7. The foam 200 is formed as a single piece and includes openings 202 sized and aligned with each of the openings 90. Consequently, light from the LEDs 46 shines through the openings 90, 202 to the lens 34. That said, the geometry of the foam 200 may require movement of one or both terminals 82, 84 to different locations on the respective buses 54, 56.

Figure 8:
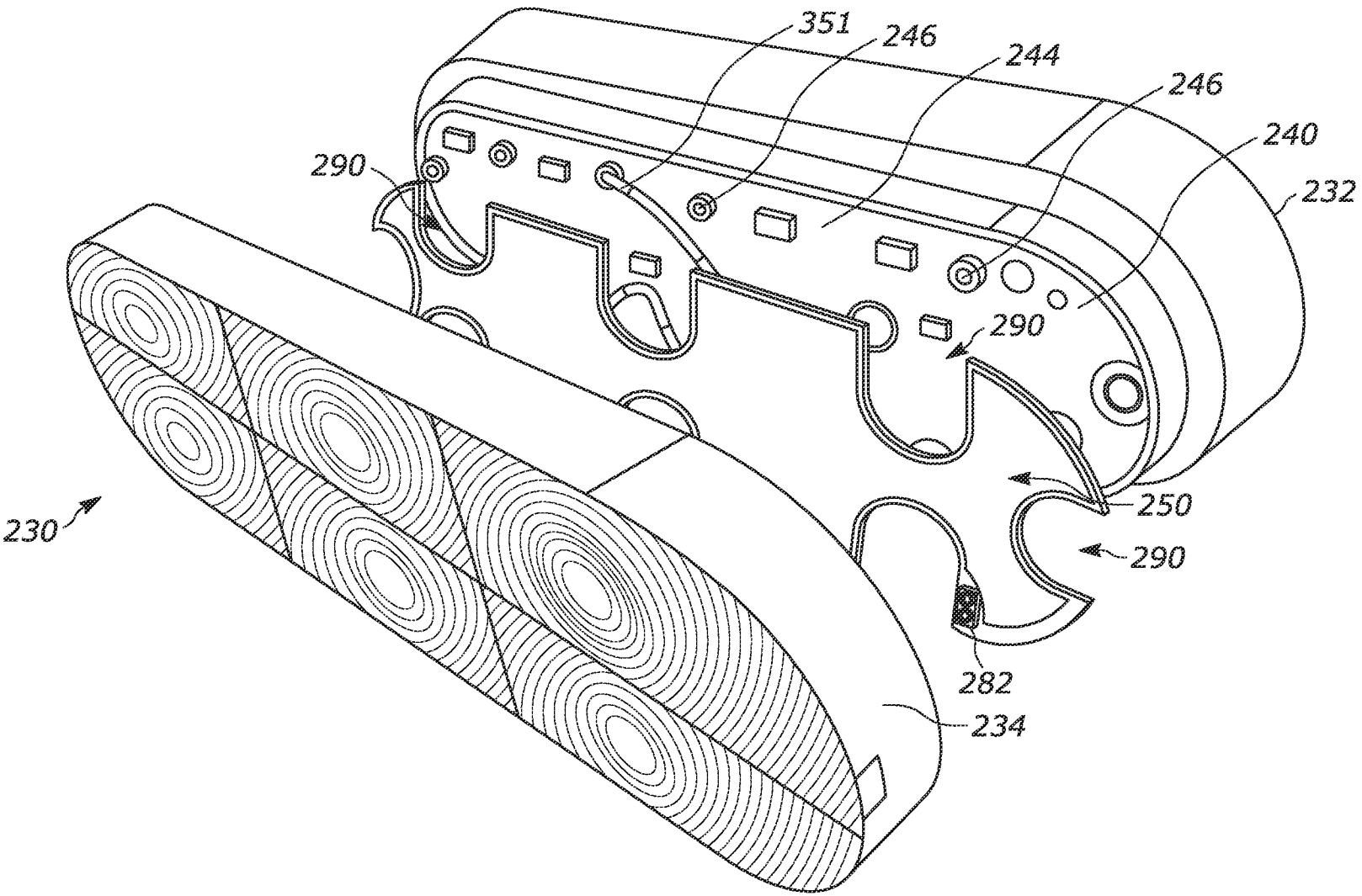
FIG. 8 is an exploded view of another example light assembly and heater system.
Figure 9:
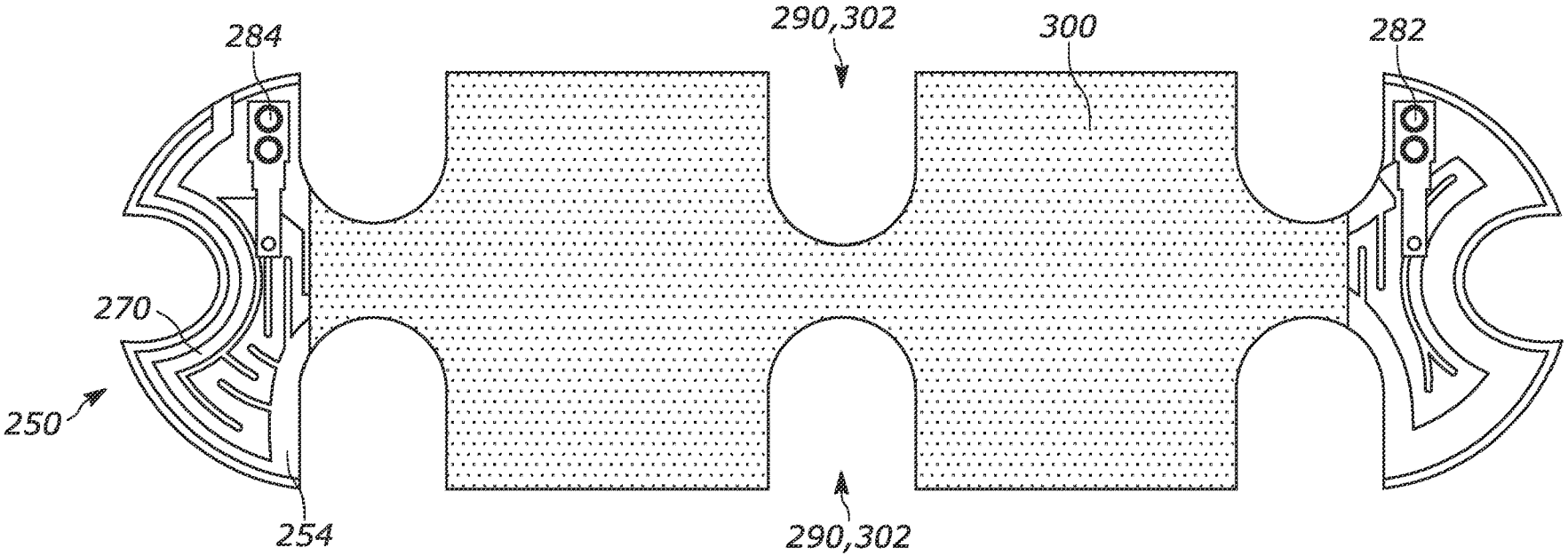
FIG. 9 is a top view of another example heater system for the light assembly of FIG. 8.

FIGS. 8-9 illustrate another example LED light assembly 230. Features in FIGS. 8-9 that are similar to those in FIGS. 1-6 are given reference numbers 200 greater than the corresponding reference number in FIGS. 1-6. In FIGS. 8-9, the LED light assembly 230 is an elongated (as opposed to round) stop-turn-tail light. The LED assembly 230 can include a foam spacer 300 (FIG. 9) or the foam spacer can be omitted (FIG. 8). Regardless, the composite 250 is spaced from and not directly secured to the lens 34.

The openings 290 in the composite 250 for the LED lights 244 are generally U-shaped or oval and extend to the perimeter of the composite, i.e., the openings 290 are defined by an open boundary. The openings 302 in the foam 300 mirror the openings 290 in shape and location.

The heater systems shown and described herein, e.g., heating elements formed as fixed wattage heaters or phase-changing composites, are advantageous in helping to avoid a hazardous condition as a result of snow buildup on LED lights, such as headlights and taillights in automotive, commercial trucking, construction, and aerospace vehicles.

The heating element is configurable to many different shapes, contours, and sizes of lights. Custom shapes and slot/hole configurations ensure proper assembly and flexibility. The heating element can be black to prevent changing the light output of the LED light. Moreover, solar power can be used to power the heating element, eliminating the concern for increasing the energy usage per intersection.

The PTC heating element may be installed without the need for sensors, thermostats, or other feedback electronics. The PTC heating element is efficient and runs at very low steady-state current. Current draw increases as temperatures decrease or snow attempts to stick to the lens surface, returning to steady state after melting.

What have been described above are examples of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. A heater system for an LED light assembly having a lens and a plurality of LED lights, comprising:

a heating element positioned behind and spaced from the lens and having openings aligned with the LED lights for allowing light from the LED lights to pass therethrough; and a foam spacer secured to the heating element for positioning the heating element a predetermined distance from the lens.

2. The heater system of claim 1, wherein the spacer includes openings aligned with the openings in the heating element.

3. The heater system of claim 1, wherein the spacer is positioned between the LED lights and the lens.

4. The heater system of claim 1, wherein the heating element is positioned between a circuit board assembly bearing the LED lights and the lens.

5. The heater system of claim 1, further comprising an interface layer directly connecting the heating element to a circuit board assembly bearing the LED lights.

6. The heater system of claim 5, wherein the interface layer comprises a double-sided adhesive for directly engaging the circuit board assembly.

7. The heater system of claim 1, wherein the openings are round.

8. The heater system of claim 1, wherein at least one of the openings is defined by an open boundary.

9. The heater system of claim 1, wherein the LED light assembly is attached to a vehicle lighting system.

10. The heater system of claim 1, wherein the heating element comprises a composite including:

a polymer base layer;

a plurality of conductive buses provided on the base layer; and a resistive layer electrically connecting the plurality of buses to form a circuit, the resistive layer comprising conductor particles dispersed in a polymer matrix, the resistive layer having a crystalline first condition prior to applying electricity to one of the buses and an amorphous second condition in response to applying electricity to one of the buses.

11. A heater system for an LED light assembly having a lens, comprising:

a board assembly having LED lights connected thereto;

a heating element positioned behind and spaced from the lens and having openings aligned with the LED lights for allowing light from the LED lights to pass therethrough; and a foam spacer secured to the heating element for positioning the heating element a predetermined distance from the lens, the spacer including openings aligned with the openings in the heating element.

12. The heater system of claim 11, wherein the spacer is positioned between the LED lights and the lens.

13. The heater system of claim 11, further comprising an interface layer directly connecting the heating element to the board assembly.

14. The heater system of claim 13, wherein the interface layer comprises a double-sided adhesive for directly engaging the board assembly.

15. The heater system of claim 11, wherein the LED light assembly is attached to a vehicle lighting system.

16. The heater system of claim 11, wherein the heating element comprises a composite including:

a polymer base layer;

a plurality of conductive buses provided on the base layer; and a resistive layer electrically connecting the plurality of buses to form a circuit, the resistive layer comprising conductor particles dispersed in a polymer matrix, the resistive layer having a crystalline first condition prior to applying electricity to one of the buses and an amorphous second condition in response to applying electricity to one of the buses.

17. The heater system of claim 11, wherein at least a portion of the heating element is screen printed directly onto the board assembly.

18. The heater system of claim 1, wherein the spacer connects the heating element to a circuit board assembly bearing the LED lights.

19. The heater system of claim 11, wherein the spacer connects the heating element to a circuit board assembly bearing the LED lights.

* * * * *